US006813915B2

(12) United States Patent
Chang

(10) Patent No.: US 6,813,915 B2
(45) Date of Patent: Nov. 9, 2004

(54) DOOR LOCK

(76) Inventor: Shih-Chung Chang, No. 61-12, Lane 124, Chiao-Chung 1st Rd., Panchiao City, Taipei Hsien (TW)

( * ) Notice: Subject to any disclaimer, the term of this patent is extended or adjusted under 35 U.S.C. 154(b) by 39 days.

(21) Appl. No.: 10/315,652

(22) Filed: Dec. 9, 2002

(65) Prior Publication Data

US 2004/0107746 A1 Jun. 10, 2004

(51) Int. Cl.[7] ..... E05B 59/00

(52) U.S. Cl. ..... 70/107; 70/110; 292/34; 292/37; 292/165

(58) Field of Search ..... 70/107–110; 292/34–37, 292/165–167

(56) References Cited

U.S. PATENT DOCUMENTS 192,724 A * 7/1877 Wike ..... 70/108
1,009,624 A * 11/1911 Arens ..... 70/343
1,099,105 A * 6/1914 Voight ..... 70/340
1,290,439 A * 1/1919 Weller ..... 70/107
1,555,532 A * 9/1925 Hoffman ..... 246/293
1,804,956 A * 5/1931 Shaw ..... 70/340
1,855,608 A * 4/1932 Lyons et al. ..... 70/107
3,769,822 A * 11/1973 Yulkowski ..... 70/107
5,263,749 A * 11/1993 Errani ..... 292/40
5,765,410 A * 6/1998 Kwan et al. ..... 70/107
5,813,255 A * 9/1998 Tell et al. ..... 70/107
6,302,456 B1 * 10/2001 Errani ..... 292/332
6,581,423 B2 * 6/2003 Lin ..... 70/107

* cited by examiner

*Primary Examiner*—Suzanne Dino Barrett
(74) *Attorney, Agent, or Firm*—Dellett & Walters

(57) ABSTRACT

A door lock has a primary dead bolt adapted to be controllably connected to a knob and an inner handle, a latch adapted to be controllably connected to the inner handle and an outer handle and a secondary dead bolt adapted to be controllably connected to the inner handle and driven by a key. Therefore, operation of the outer handle retracts the latch and operation of the inner handle retracts both the primary dead bolt and the secondary dead bolt.

14 Claims, 9 Drawing Sheets

DOOR LOCK

BACKGROUND OF THE INVENTION

1. Field of the Invention

The present invention relates to a door lock, and more particularly to a door lock enabling the user to escape outdoors without using the key to unlock the lock even when the door is locked.

2. Description of Related Art

A door normally has an inner handle and an outer handle to respectively retract the latch bolt so as to open the door. However, when the door is locked from inside at night to prevent any unauthorized personnel to break into the home, the user will have to at least operate the inner handle and the knob to unlock the latch bolt so as to open the door. When there is an emergency inside the house, time is the most important factor for the people to escape outdoors. Therefore, when the door is locked, seconds delay trying to open the door from inside the house might become lethal.

A conventional door usually is equipped with a primary dead bolt and a secondary dead bolt. The primary dead bolt is able to be operated by a knob and the secondary dead bolt can only be operated by a proper key. Therefore, for the sake of safety, some householders often lock the door by activating the secondary dead bolt at night with the key. However, when there is a fire or other emergency requiring the family members to escape outdoors, the time to find the key to deactivate the secondary dead bolt often is the cause of casualty.

To overcome the shortcomings, the present invention tends to provide an improved door lock to mitigate and obviate the aforementioned problems.

SUMMARY OF THE INVENTION

The primary objective of the present invention is to provide an improved door lock to enable the user to simultaneously deactivate the primary dead bolt and the secondary dead bolt by operation of the inner handle so as to allow the user to have access to the outside of the house even when the primary dead bolt and the secondary dead bolt are locked.

In order to accomplish the foregoing objective, the door lock of the present invention has a primary dead bolt securely attached to a first linking plate and operably controlled by a knob, a latch adapted to be controlled by an outer handle and a secondary dead bolt operably adapted to be controlled by a key, wherein the primary dead bolt, the latch and the secondary dead bolt are adapted to be operably controlled by an inner handle. Therefore, even when the primary dead bolt and the secondary dead bolt are locked by activating the knob and the key, operation of the inner handle is able to deactivate the locked primary dead bolt and the secondary dead bolt simultaneously as well as the latch.

Other objects, advantages and novel features of the invention will become more apparent from the following detailed description when taken in conjunction with the accompanying drawings.

DETAILED DESCRIPTION OF THE PREFERRED EMBODIMENT

Figure 1:
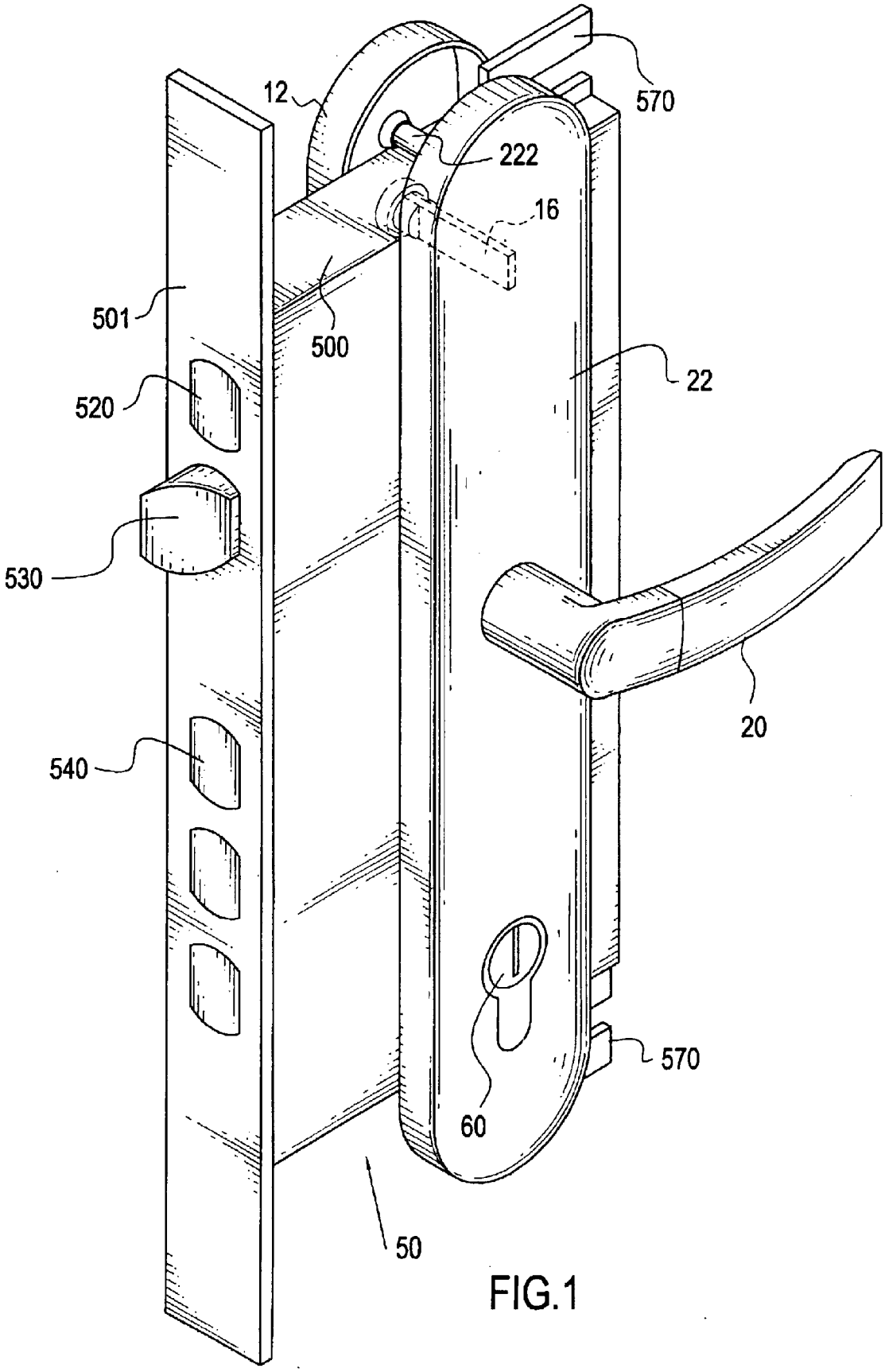
FIG. 1 is a perspective view of the door lock adapted to be equipped with an outer handle.
Figure 2:
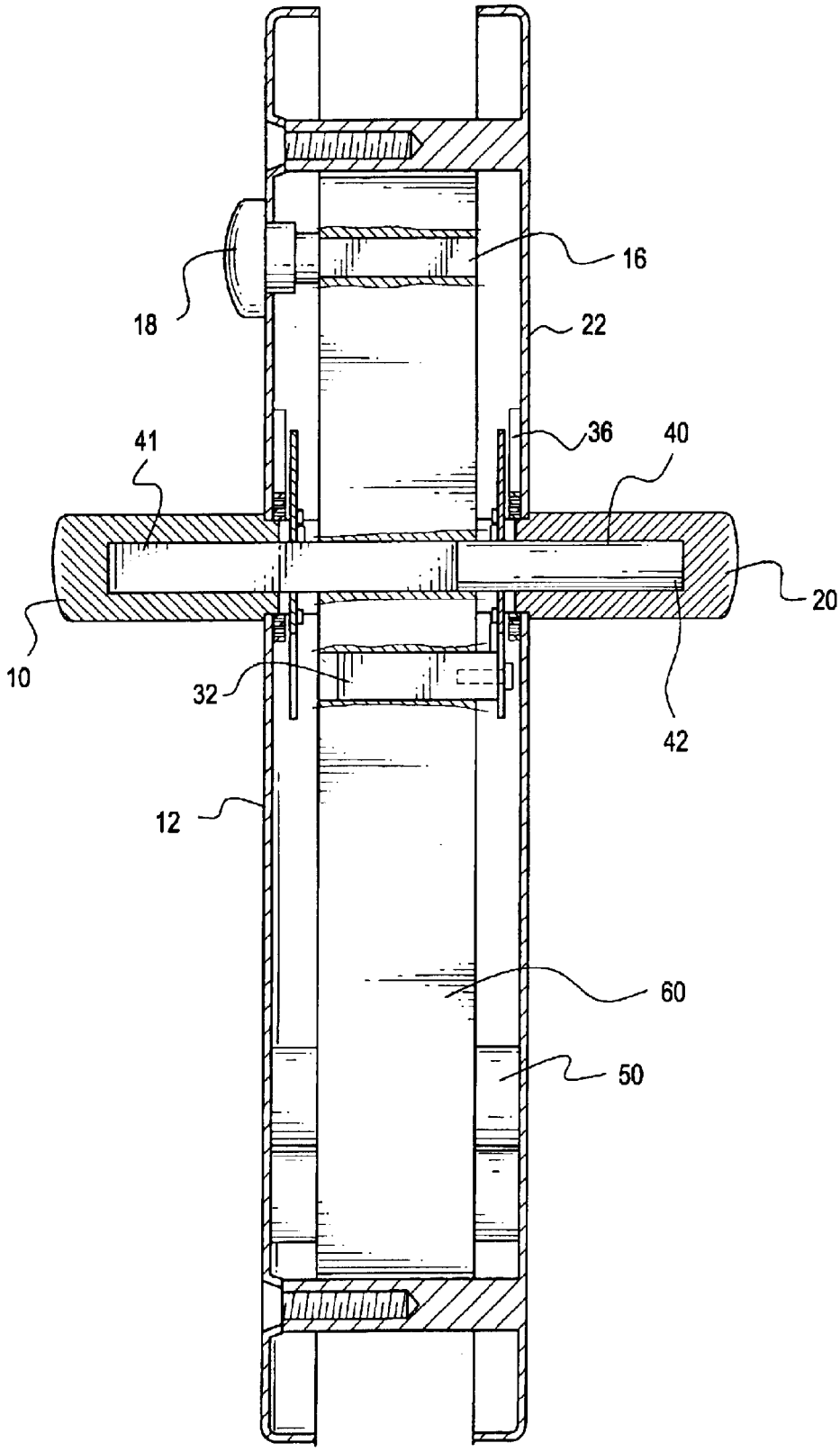
FIG. 2 is a schematic cross sectional view showing an inner handle is opposite to the outer handle.

With reference to FIGS. 1 and 2, the door lock (50) in accordance with the present invention is adapted to be used with an inner handle (10) and an outer handle (20). The door lock (50) has a housing (500) to slidably receive therein a primary dead bolt (520), a latch (530) and a secondary dead bolt (540), wherein the primary dead bolt (520), the latch (530) and the secondary dead bolt (540) selectively extend out from a panel (501) of the housing (500).

In order to have an integral structure, an outer cover (22) with a keyhole (60) defined in a face of the outer cover (22) and an inner cover (12) are adapted to engage with the door lock (50) of the present invention.

The inner cover (12) further has a knob (18) adapted to extend into the inner cover (12) to connect to a control rod (16) so as to control the rotation of the control rod (16). A long shaft (40) is sandwiched between the inner handle (10) and the outer handle (20). The long shaft (40) has a first end (41) securely connected to the inner handle (10) and a second end (42) rotatable relative to the outer handle (20). Therefore, rotation of the inner handle (10) drives the rotation of the long shaft (40). However, because the long shaft (40) is rotatable with respect to the outer handle (20), rotation of the long shaft (40) does not drive the outer handle (20). Still, a short shaft (32) is driven by the outer handle (20) via a linkage mechanism (not shown).

Figure 3:
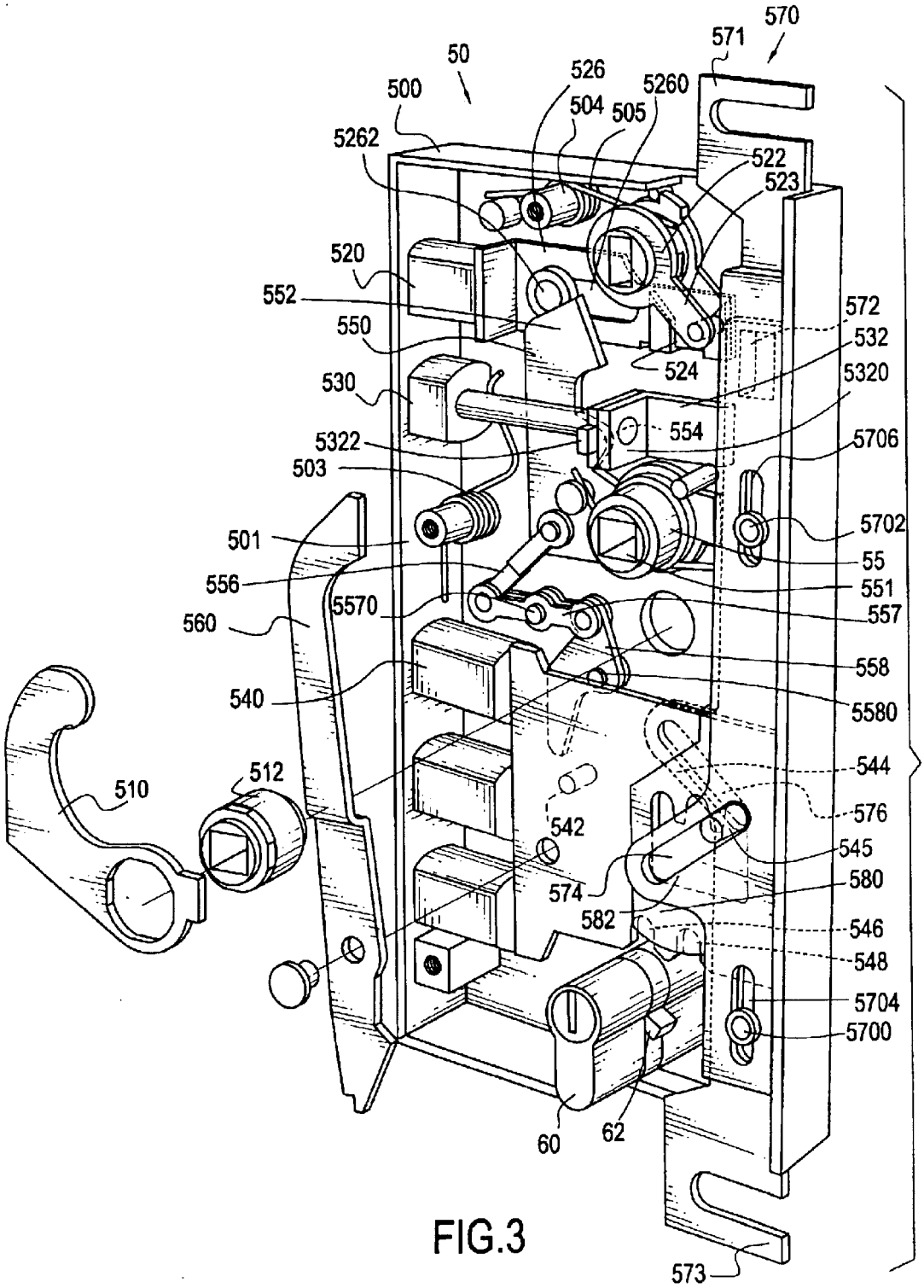
FIG. 3 is an exploded perspective view showing the inner structure of the door lock of the present invention.

With reference to FIG. 3, the door lock (50) of the present invention has a first rose (522) adapted to securely connect to the control rod (16) of the knob (18) to be pivotally received in the housing (500) and having a push end (523). A positioning rod (504) is formed on a face of the housing (500) to allow a first spring (505) to be mounted around the positioning rod (504). The first spring (505) provides a stable pivotal force to the first rose (522) by abutting a first end of the first spring (505) to an inner face of the housing (500) and a second end of the first spring (505) to the first rose (522). The primary dead bolt (520) has a first connecting plate (526) integrally formed with the primary dead bolt (520) and having a recessed space (524) defined to receive therein the push end (523) of the first rose (522) and a long hole (5260) defined to receive therein a positioning pin (5262). Therefore, it is noted from the foregoing description that when the user rotates the knob (18) to drive the control rod (16) to rotate as well, the rotation of the first rose (522) will drive the primary dead bolt (520) linearly to selectively end out from the panel (501).

A second rose (512) is adapted to be pivotally connected to the outer handle (20) via the short shaft (32) and has an arm (510) securely mounted on the second rose (512).

The latch (530) is integrally formed with a second connecting plate (532) provided with two bosses (5322) oppositely formed on the second connecting plate (532) to guide the latch (530) to move linearly in the housing (500). A second spring (503) securely provided in the housing (500) abuts a side face of the latch (530) to maintain the latch (530) extending out of the housing (500) from the panel (501).

An L-shaped link (550) has a vertical portion with a first push (552) adjacent to the first rose (522) and a second push (554) adjacent to the second connecting plate (532) and a horizontal portion.

A third rose (55) is pivotally mounted in the housing (500) and is securely mounted on the horizontal portion of the link (550). The third rose (55) is adapted to be securely connected to the inner handle (10) so that the third rose (55) is able to be pivoted by the inner handle (10).

The second connecting plate (532) has a first pivot arm (556) pivotally connected to the L-shaped link (550), a second pivot arm (557) pivotally connected to a free end of the first pivot arm (556) and having a first pivot pin (5570) in a mediate portion of the second pivot arm (557) to pivotally mount the second pivot arm (557) on the housing (500) and a third pivot arm (558) pivotally connected to a free end of the second pivot arm (557) and having a second pivot pin (5580) to pivotally mount the third pivot arm (558) on the housing (500). Therefore, rotation of the inner handle (10) not only drives the third rose (55) to pivot, but also drives the link (550) and the third pivot arm (558) to move.

A third connecting plate (544) is securely formed with the secondary dead bolt (540) and having a first boss (542) to be connected to a free end of the third pivot arm (558) and a second boss (545). The third connecting plate (544) defines therein a first cutout (546) and a second cutout (548). A linking arm (560) is pivotally mounted on the third connecting plate (544) and has a first end and a second end abutted to a face of the second connecting plate (532).

A core is rotatably received in the keyhole (60) and is operably controlled by a key (not shown). The core has an extension (62) selectively abutted to the first end of the linking arm (560).

The door lock (50) of the present invention further has a door frame locking mechanism (570). The door frame locking mechanism (570) has a first slide (571) and a second slide (573) slidable with respect to the first slide (571). Each of the first and second slides (571,573) has a pair of elongated holes (5704,5706) (only the elongated holes of the first slide are shown) so that a pair of pivot pins (5700,5702) are able to respectively received in the aligned pair of elongated holes (5704,5706) to regulate the movement of the first and second slides (571,573). The first slide (571) has a downwardly extending inclined hole (574) and the second slide (573) has an upwardly extending inclined hole (576). The inclined holes (574,576) are respectively defined to receive therein the second boss (545) of the third connecting plate (544). Furthermore, with reference to FIG. 4, the second slide (573) has a stop (572) formed to correspond to the second connecting plate (532).

A plate (580) is sandwiched between the third connecting plate (544) and the first slide (571) and has two holes (not shown) respectively aligned with the pair of elongated holes (5704,5706) to receive therein the pivot pins (5700,5702) so that the movements of the first slide (571) and the second slide (573) are regulated by the pivot pins (5700,5702). The plate (580) further has a first notch (582), a second notch (584) and a third notch (586) respectively formed to correspond to the second boss (545) of the third connecting plate (544).

Figure 4:
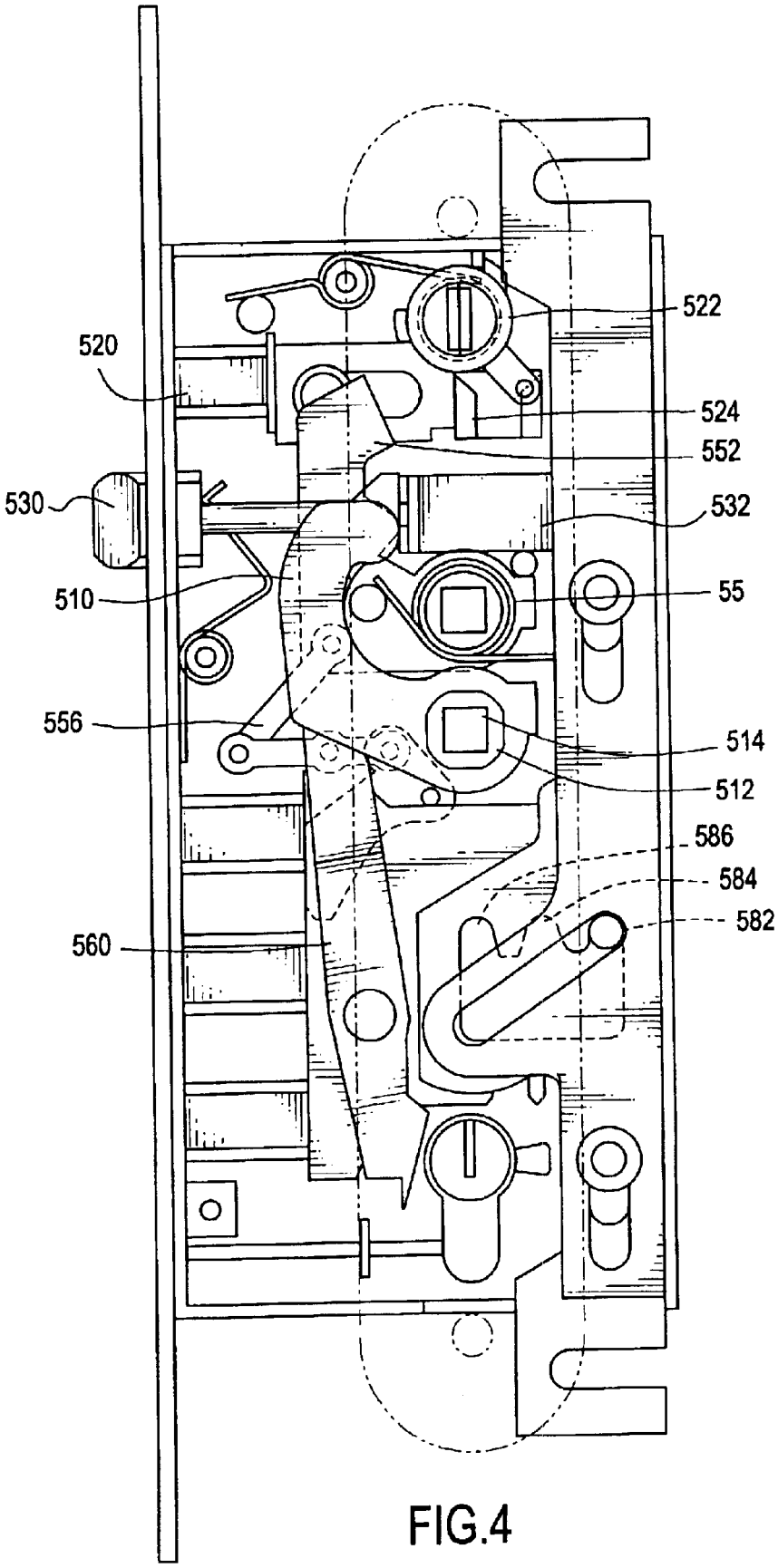
FIG. 4 is a side plan view showing that the door lock of the present invention is assembled.
Figure 5:
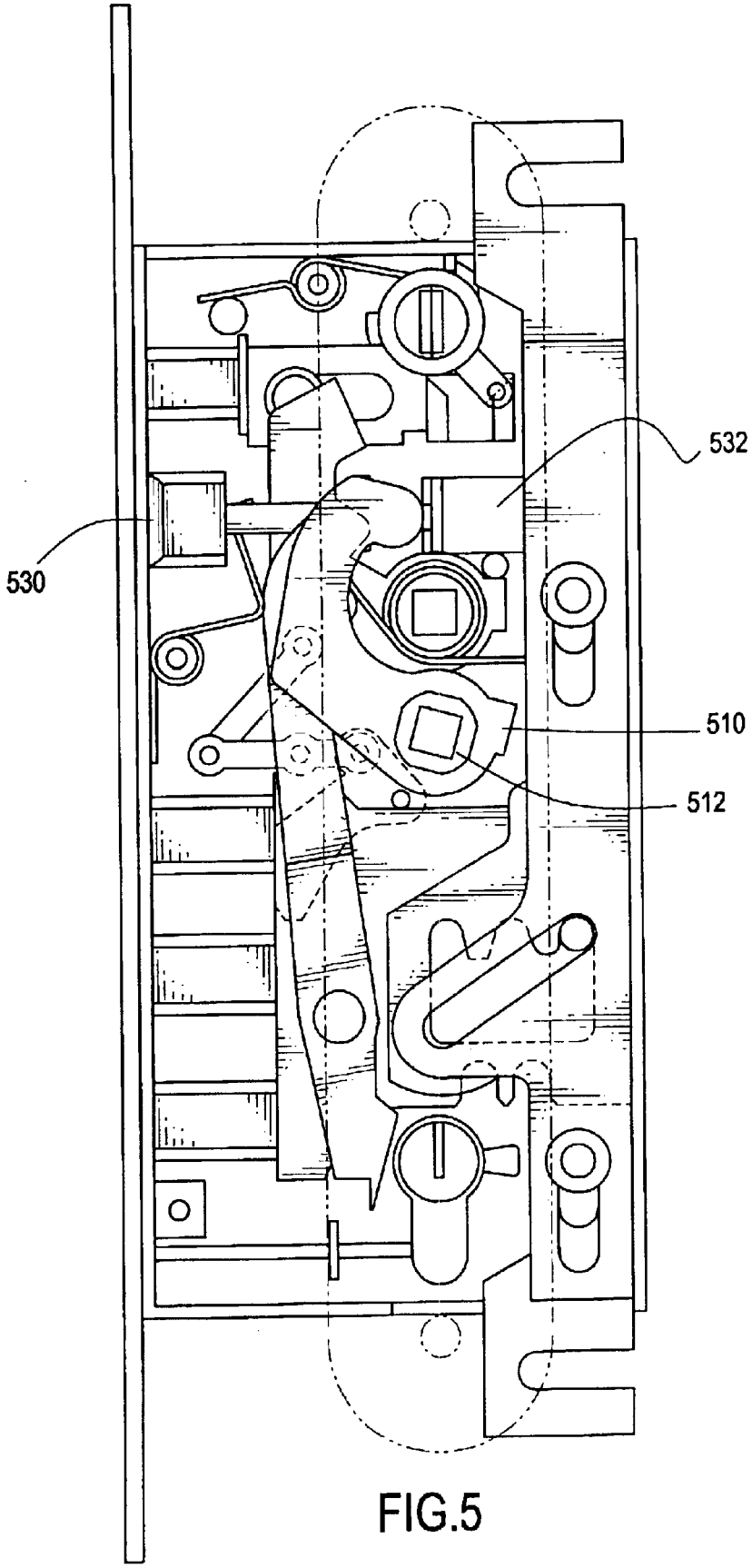
FIG. 5 is a schematic view of the operation inside the door lock after the outer handle is operated.

With reference to FIGS. 4 and 5, it is noted that the latch (530) selectively extends out of the housing (500) from the panel (501) so that when the door (not shown) is closed and the user operates the outer handle (20), the second rose (512) is pivoted and thus the arm (510) is pivoted to push the second connecting plate (532). After the second connecting plate (532) is pushed by the arm (510), the latch (530) is retracted by the movement of the second connecting plate (532). Thus, the door is opened. Therefore, from the aforementioned description, operation of the outer handle (20) can only operate the retraction of the latch (530) and nothing else.

Figure 6:
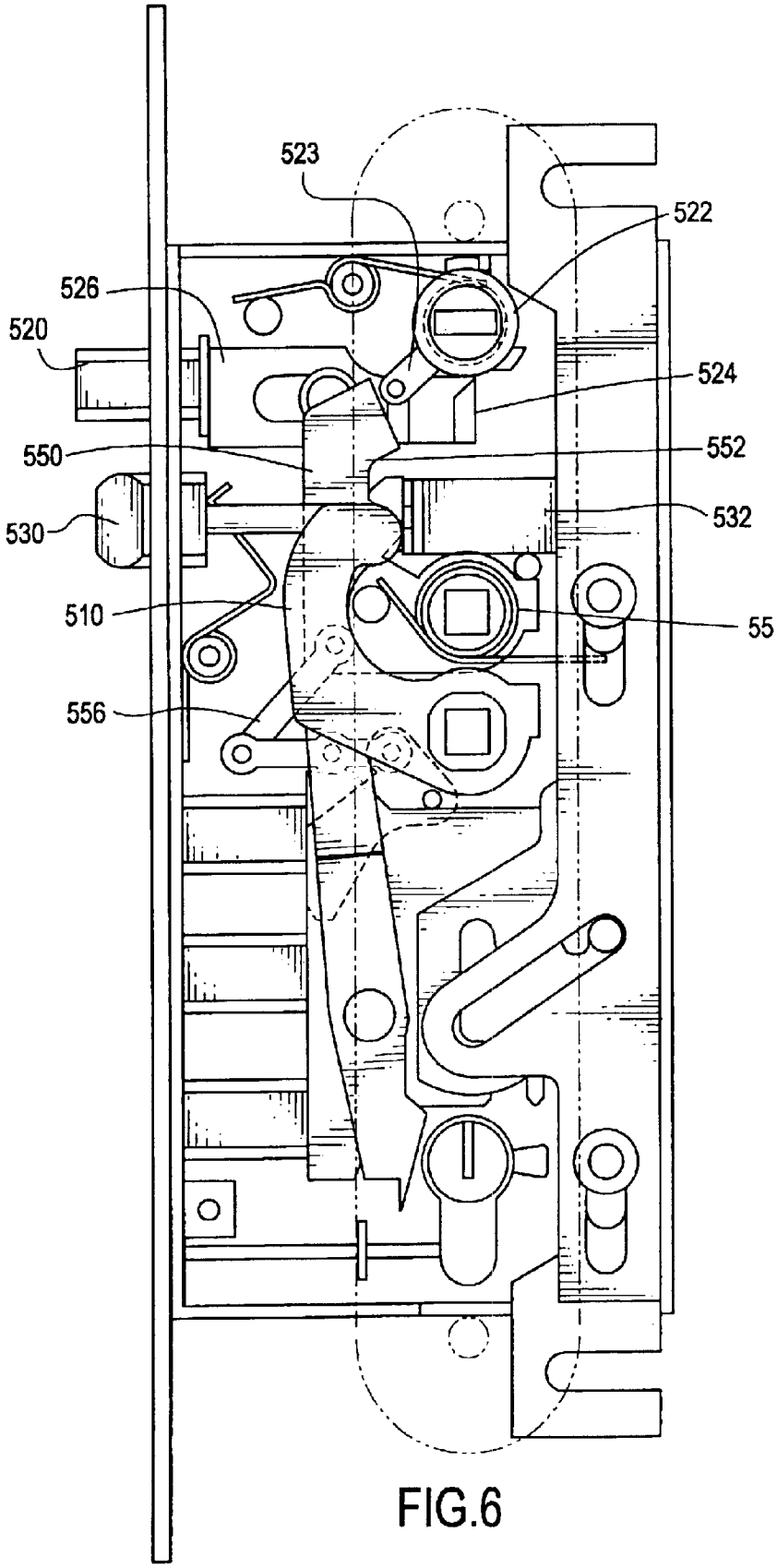
FIG. 6 is a schematic view of the activation of the primary dead bolt.
Figure 7:
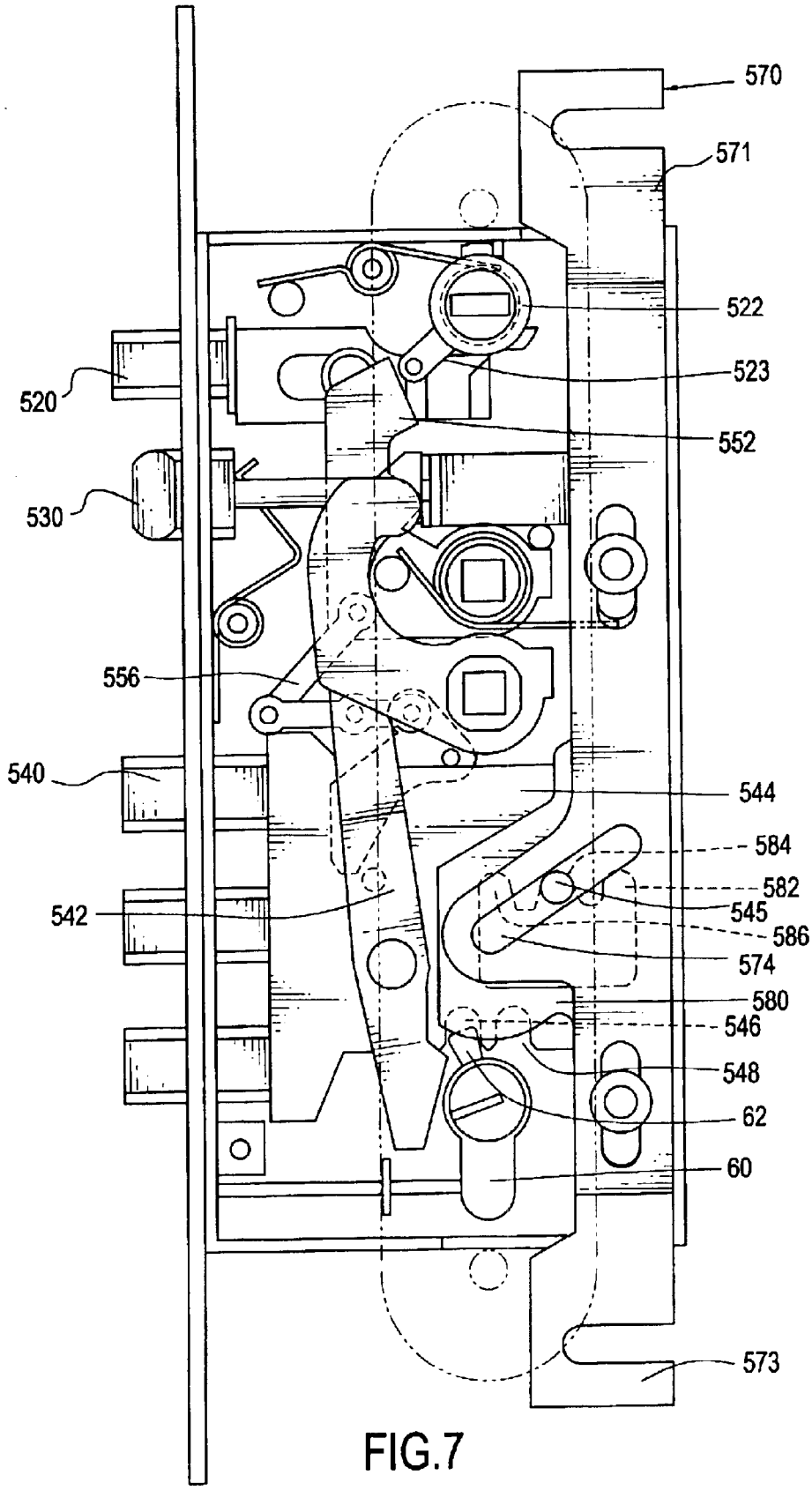
FIG. 7 is a schematic view of the activation of the secondary dead bolt.
Figure 8:
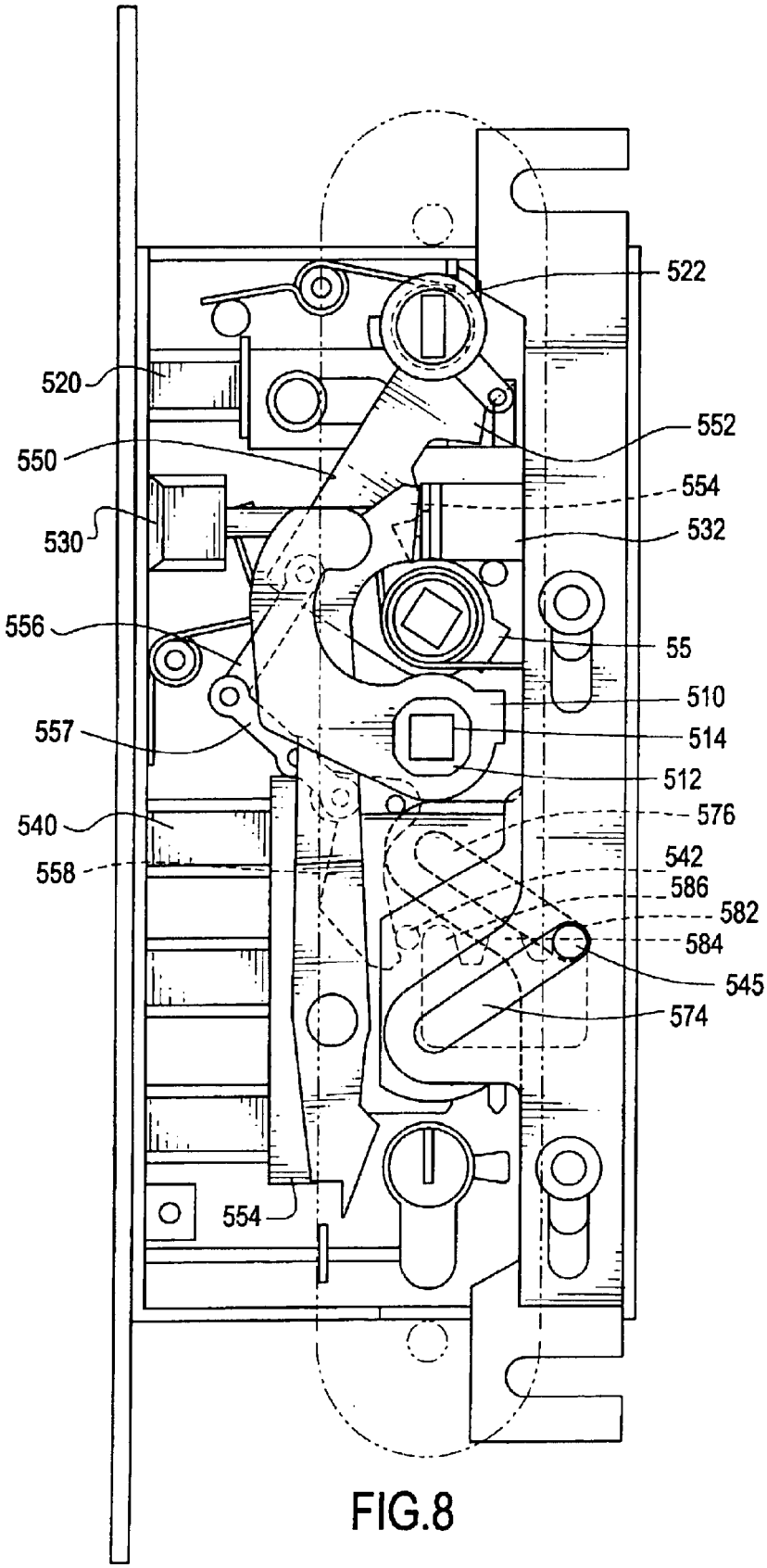
FIG. 8 is a schematic view of retracting the primary dead bolt and the secondary dead bolt by the operation of the inner handle.
Figure 9:
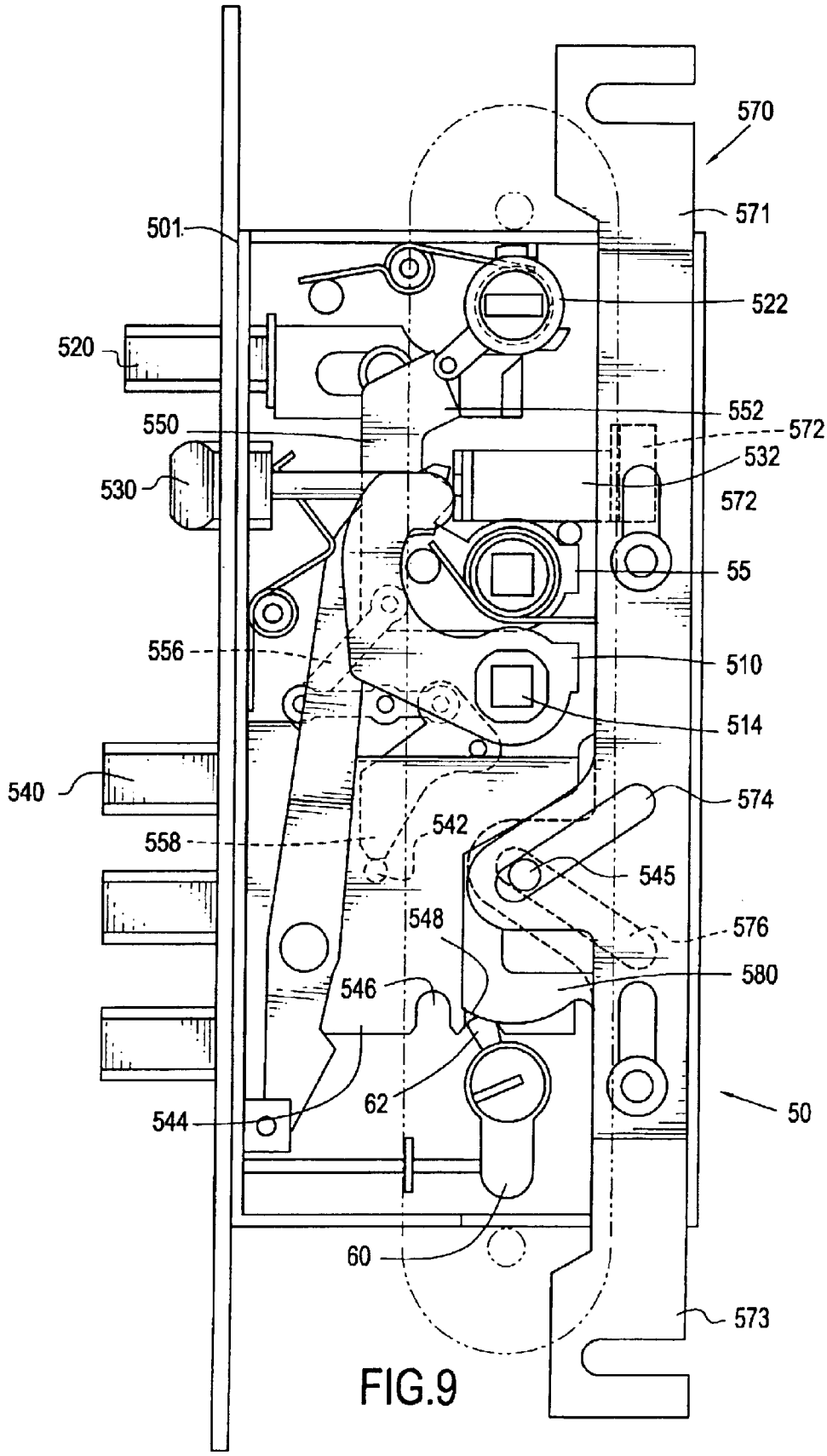
FIG. 9 is a schematic view showing that the latch, the primary dead bolt and the secondary dead bolt are locked by rotation of the key.

In a scenario that supposes the family activates all the locking mechanisms, that is, the primary dead bolt (520) via operation of the knob (18) and the secondary dead bolt (540) via a proper key, as shown in FIGS. 6, 7 and 8, in the door lock at night to prevent any burglar or thief, the extension (62) abuts a face of the first cutout (546) of the third connecting plate (544) to move the secondary dead bolt (540) out of the housing (500). However, when the secondary dead bolt (540) is moving out of the housing (500) from the panel (501), the movement of the third connecting plate (544) allows the second boss (545) to force the first slide (571) to move upward to lock the upper frame of the door and the second slide (573) to move downward to lock the lower frame of the door via the downwardly extending inclined hole (574) and the upwardly extending inclined hole (576). Furthermore, the second boss (545) moves from the first notch (582) to the second notch (584) of the plate (580) while the first slide (571) moves upward and the second slide (573) moves downward as well as the plate (580) moves upward once so that both the first slide (571) and the second slide (573) are positioned. After all the locking mechanism of the door lock of the present invention is activated and if there is an emergency happening inside the house, the user operates the inner handle (10) so as to start a series of chain reaction to deactivate the primary dead bolt (520), the latch (530) and the secondary dead bolt (540). Thus, the user is able to have access outside the house easily without using the key to unlock the door lock.

Detailed description of the series of chain reaction is as follows:

After the user activates the inner handle (10), referring to FIG. 3, the third rose (55) as well as the link (550) is pivoted. The second push (554) pushes the second connecting plate (532) so that the latch (530) is retracted inside the housing (500). While the link (550) is pivoted and the second push (554) pushes the second connecting plate (532), the first push (552) of the link (550) pushes the push end (523) of the first rose (522), which directs the primary dead bolt (520) to be retracted inside the housing (500).

Sill, the movement of the link (550) also drives the third pivot arm (558) to push the first boss (542) of the third connecting plate (544). Thus the secondary dead bolt (540) retracts inside the housing (500).

Again, the movement of the third connecting plate (544) to retract the secondary dead bolt (540) inside the housing (500) allows the second boss (545) to move from the second notch (584) to move back to the first notch (582). Therefore, both the first slide (571) and the second slide (573) retract from their respective extending positions to their original deactivated positions.

However, when the key is rotated twice, the secondary dead bolt (540) is driven to a full extent, which also drives the first slide (571) and the second slide (573) to extend further into the door frame. Meanwhile, after the second slide (573) moves downward to allow the stop (572) to abut a free end of the second connecting plate (532), the latch (530) is stopped. Therefore, the user can still use the key to operate the lock to a fully locked position.

In summary, at night, even when the lock of the present invention is locked by a key which is rotated once, the personnel inside the house can still open the door by simply operating the inner handle (10) without the assistance of that particular key to deactivate the lock. However, when it is sure that there is nobody left inside the house, the user can rotate the key twice to fully activate the lock so that only with use of the key, the user is able to deactivate the lock so as to ensure property safety.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a door lock having a housing with an inner handle pivotally connected to the housing and an outer handle pivotally connected to the housing, a primary dead bolt operably extending out of the housing, a latch selectively extending out of the housing and a secondary dead bolt, wherein the improvement comprises:

a first connecting plate adapted to engage with the primary dead bolt and be slidably received in the housing;

a first rose adapted to be pivotally received in the housing;

a second connecting plate adapted to be slidably received in the housing and engaged with the latch;

a second rose adapted to be pivotally received in the housing to drive the second connecting plate and to selectively drive the first connecting plate, the second rose being adapted to be connected to the inner handle so that the pivotal movement of the inner handle is able to drive the second rose to move the second connecting plate and to selectively drive the first connecting plate so as to retract the latch into the housing and the primary dead bolt when extending out of the housing;

a third connecting plate adapted to engage with the secondary dead bolt and be slidably received in the housing, the third connecting plate being controllably connected to the second rose and adapted to be controlled to slide by a key; and a third rose adapted to be pivotally received in the housing and engaged with the outer handle so as to control the slidable movement of the second connecting plate to retract the latch.

2. The door lock as claimed in claim 1 further comprising a linking arm pivotally mounted on the third connecting plate and provided with a distal end abutted to the second connecting plate so that the slidable movement of the third connecting plate is able to move the second connecting plate to retract the latch.

3. The door lock as claimed in claim 1 further comprising a link formed with the second rose and having a first push selectively engaged with the first rose and a second push abutted to the second connecting plate such that the pivotal movement of the second rose is able to retract the latch and to retract the primary dead bolt when extending out of the housing.

4. The door lock as claimed in claim 2 further comprising a link formed with the second rose and having a first push selectively engaged with the first rose and a second push abutted to the second connecting plate such that the pivotal movement of the second rose is able to retract the latch and to retract the primary dead bolt when extending out of the housing.

5. The door lock as claimed in claim 3 further comprising a first pivot arm with a first distal end pivotally connected to the link and a second distal end pivotally connected to a second pivot arm which having a mediate portion adapted to be pivotally connected to a face of the housing and a third pivot arm connected to a free end of the second pivot arm and having a pivot pin to pivotally mount the third pivot arm on the face of the housing, wherein the third connecting plate has a first boss formed on the third connecting plate to selectively abut a free end of the third connecting plate such that the pivotal movement of the link is able to drive the third connecting plate to retract the secondary dead bolt when extending out of the housing.

6. The door lock as claimed in claim 4 further comprising a first pivot arm with a first distal end pivotally connected to the link and a second distal end pivotally connected to a second pivot arm which having a mediate portion adapted to be pivotally connected to a face of the housing and a third pivot arm connected to a free end of the second pivot arm and having a pivot pin to pivotally mount the third pivot arm on the face of the housing, wherein the third connecting plate has a first boss formed on the third connecting plate to selectively abut a free end of the third connecting plate such that the pivotal movement of the link is able to drive the third connecting plate to retract the secondary dead bolt when extending out of the housing.

7. The door lock as claimed in claim 1 further comprising a first slide adapted to be vertically slidable relative to the housing, a second slide adapted to be vertically slidable relative to the housing and a plate sandwiched between the third connecting plate and the second slide and having a first notch, a second notch and a third notch defined to sequentially receive therein a second boss formed on the third connecting plate, such that the slidable movement of the third connecting plate is able to move the second boss from a first notch to a second notch or from a second notch to the third notch so as to respectively position the first slide and the second slide.

8. The door lock as claimed in claim 3 further comprising a first slide adapted to be vertically slidable relative to the housing, a second slide adapted to be vertically slidable relative to the housing and a plate sandwiched between the third connecting plate and the second slide and having a first notch, a second notch and a third notch defined to sequentially receive therein a second boss formed on the third connecting plate, such that the slidable movement of the third connecting plate is able to move the second boss from a first notch to a second notch or from a second notch to the third notch so as to respectively position the first slide and the second slide.

9. The door lock as claimed in claim 5 further comprising a first slide adapted to be vertically slidable relative to the housing, a second slide adapted to be vertically slidable relative to the housing and a plate sandwiched between the third connecting plate and the second slide and having a first notch, a second notch and a third notch defined to sequentially receive therein a second boss formed on the third connecting plate, such that the slidable movement of the third connecting plate is able to move the second boss from a first notch to a second notch or from a second notch to the third notch so as to respectively position the first slide and the second slide.

10. The door lock as claimed in claim 6 further comprising a first slide adapted to be vertically slidable relative to the housing, a second slide adapted to be vertically slidable relative to the housing and a plate sandwiched between the third connecting plate and the second elide and having a first notch, a second notch and a third notch defined to sequentially receive therein a second boss formed on the third connecting plate, such that the slidable movement of the third connecting plate is able to move the second boss front a first notch to a second notch or from a second notch to the third notch so as to respectively position the first slide and the second slide.

11. The door lock as claimed in claim 7, wherein the third connecting plate has a first cutout and a second cutout adapted to be controllably driven by a key so that the slidable movement of the third connecting plate by the key is able to move the first slide and the second slide to move respectively.

12. The door lock as claimed in claim 8, wherein the third connecting plate has a first cutout and a second cutout adapted to be controllably driven by a key so that the slidable movement of the third connecting plate by the key is able to move the first slide And the second slide to move respectively.

13. The door lock as claimed in claim 9, wherein the third connecting plate has a first cutout and a second cutout adapted to be controllably driven by a key so that the slidable movement of the third connecting plate by the key is able to move the first slide and the second slide to move respectively.

14. The door lock as claimed in claim 10, wherein the third connecting plate has a first cutout and a second cutout adapted to be controllably driven by a key so that the slidable movement of the third connecting plate by the key is able to move the first slide and the second slide to move respectively.

* * * * *